US007441278B2

(12) United States Patent
Blakeley

(10) Patent No.: US 7,441,278 B2
(45) Date of Patent: Oct. 28, 2008

(54) CONVERTIBLE BODY ARMOR

(76) Inventor: Kenneth Christopher Blakeley, 4008 Yarmouth La., Bowie, MD (US) 20715

( * ) Notice: Subject to any disclaimer, the term of this patent is extended or adjusted under 35 U.S.C. 154(b) by 0 days.

(21) Appl. No.: 11/418,874

(22) Filed: May 4, 2006

(65) Prior Publication Data

US 2007/0266469 A1 Nov. 22, 2007

(51) Int. Cl.

| | |
|---|---|
| ***F41H 1/00*** | (2006.01) |
| ***F41H 1/02*** | (2006.01) |
| *F41H 5/08* | (2006.01) |
| *F41H 13/00* | (2006.01) |

(52) U.S. Cl. ..... 2/2.5; 2/72; 2/84; 2/92; 2/102; 2/202; 2/204; 2/205; 2/209.11; 2/301

(58) Field of Classification Search ..... 2/2.5, 2/72, 84, 92, 102, 202, 204, 205, 209.11, 2/301

See application file for complete search history.

(56) References Cited

U.S. PATENT DOCUMENTS

| | | | | | |
|---|---|---|---|---|---|
| 3,843,969 | A | * | 10/1974 | George et al. | 2/2.5 |
| 4,546,863 | A | * | 10/1985 | Kaufman | 190/102 |
| 4,830,245 | A | * | 5/1989 | Arakaki | 224/628 |
| 5,031,733 | A | * | 7/1991 | Chang | 190/1 |
| 5,060,314 | A | | 10/1991 | Lewis | |
| 5,431,318 | A | | 7/1995 | Garcia | |
| 5,617,582 | A | * | 4/1997 | Burwell | 2/102 |
| 5,644,792 | A | | 7/1997 | Tishler et al. | |
| 6,029,270 | A | * | 2/2000 | Ost et al. | 2/2.5 |
| 6,131,198 | A | * | 10/2000 | Westrick | 2/102 |
| 6,161,738 | A | | 12/2000 | Norris | |
| 6,419,132 | B1 | | 7/2002 | Reed et al. | |
| 6,681,399 | B1 | * | 1/2004 | Kerr | 2/2.5 |
| 6,685,071 | B2 | | 2/2004 | Prather | |
| 6,732,891 | B2 | * | 5/2004 | Locklear, III | 224/244 |
| 2004/0177425 | A1 | * | 9/2004 | Kerr | 2/2.5 |

* cited by examiner

*Primary Examiner*—Bobby H Muromoto, Jr.
(74) *Attorney, Agent, or Firm*—Chernow Katz LLC

(57) ABSTRACT

A convertible body armor and carrying bag includes a first panel and a second panel. Each panel has body armor material incorporated therein. A pair of shoulder straps is provided, each having a first end secured to the first panel adjacent a first edge of the first panel, and a second end secured to the second panel adjacent a first edge of the second panel, with the shoulder straps spaced apart from each other by a space that corresponds to the distance between an adult human being's shoulders. A removable attachment mechanism removably attaches the peripheries of the panels in a manner such that the panels and the attachment mechanism together define an interior storage space when the attachment mechanism attaches the peripheries of the panels, and the panels can be worn as a body vest with the shoulder straps supported on an adult human being's shoulders when the attachment mechanism does not attach the peripheries of the panels. A weapon can be stored inside the interior storage space.

20 Claims, 10 Drawing Sheets

CONVERTIBLE BODY ARMOR

BACKGROUND OF THE INVENTION

1. Field of the Invention

The present invention relates to a convertible bag and body armor, and in particular, to a bag that can be used to carry a gun or other weapon, and which can be converted into use as body armor.

2. Description of the Prior Art

Body armor has become increasingly prevalent in today's world. In addition, most people who wear body armor will normally be carrying a weapon as well. For example, police officers, soldiers and security guards often wear body armor and carry weapons at the same time. Since body armor and weapons are separate items, it can be inconvenient for the user to carry both items separately when these items are not being used. Some users end up carrying the weapon on a belt or in a carrying case while simultaneously wearing the body armor. Unfortunately, it can be uncomfortable to wear the body armor at all times, especially when it is not necessary to do so.

SUMMARY OF THE INVENTION

It is an object of the present invention to provide a body armor that is effective in protecting the wearer.

It is another object of the present invention to provide a body armor that can be converted into a bag to hold a weapon.

In order to accomplish the above-described and other objects of the present invention, the present invention provides a convertible body armor and carrying bag that includes a first panel and a second panel. Each panel has body armor material incorporated therein. A pair of shoulder straps is provided, each having a first end secured to the first panel adjacent a first edge of the first panel, and a second end secured to the second panel adjacent a first edge of the second panel, with the shoulder straps spaced apart from each other by a space that corresponds to the distance between an adult human being's shoulders. A removable attachment mechanism removable attaches the peripheries of the panels in a manner such that the panels and the attachment mechanism together define an interior storage space when the attachment mechanism attaches the peripheries of the panels, and the panels can be worn as a body vest with the shoulder straps supported on an adult human being's shoulders when the attachment mechanism does not attach the peripheries of the panels. A weapon can be stored inside the interior storage space.

DETAILED DESCRIPTION OF THE PREFERRED EMBODIMENTS

Figure 1:
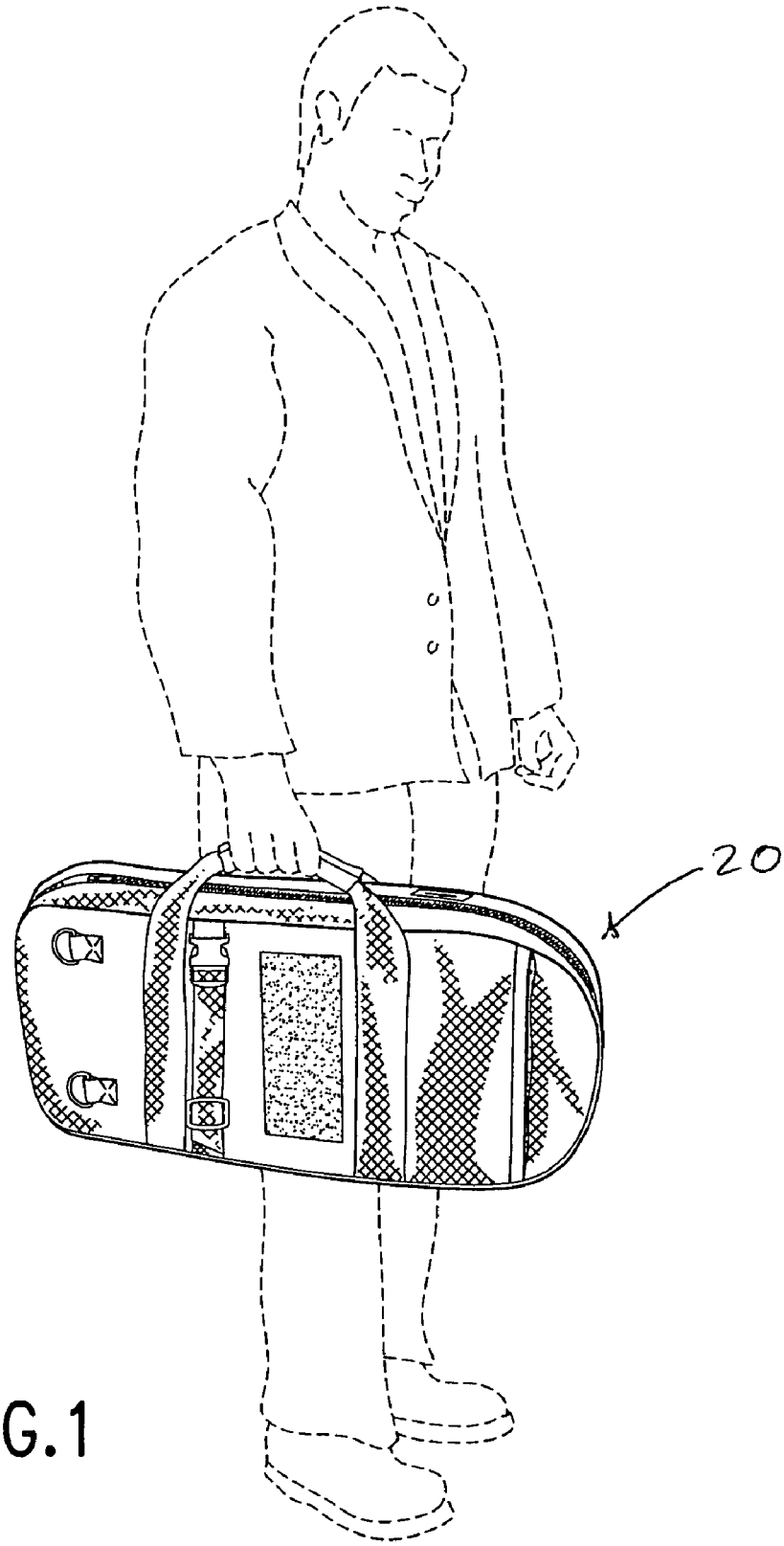
FIG. 1 illustrates the body armor of the present invention in use as a carrying bag for a weapon.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention is directed to a multi-functional body armor that can be worn as a body vest to protect the user's upper body, yet can be converted into either a hand-held carrying bag or backpack for use in holding a weapon. Thus, the present invention provides convenience to the user by allowing the user to combine a weapon and a body armor into a single item for carrying purposes, yet be able to separate them quickly and conveniently for use as separate items.

Referring to FIGS. 1-11, the body armor 20 according to the present invention is comprised of two separate panels 22 and 24 that are permanently connected by two shoulder straps 26, and also removable connected via zippers 28 that extend along the peripheral edges of the panels 22 and 24. Instead of zippers 28, other removable attachment mechanisms (e.g., VELCRO™ pads) can also be used to attach the edges of the panels 22 and 24. Each panel 22, 24 has a generally four-sided configuration, with each panel 22 and 24 have a generally rounded outer or bottom edge 30 and 32, respectively, and inner or upper edges 34 and 36, respectively. A handle 38 and 40 extends from a side edge 42 and 44, respectively, of the panels 22 and 24, respectively. The panel 22 has an outer surface 46 and an inner surface 48, and the panel 24 has an outer surface 50 and an inner surface 52, with an inner cavity defined by each pair of outer and inner surfaces 46+48 and 50+52, and the zippers 28.

Figure 9:
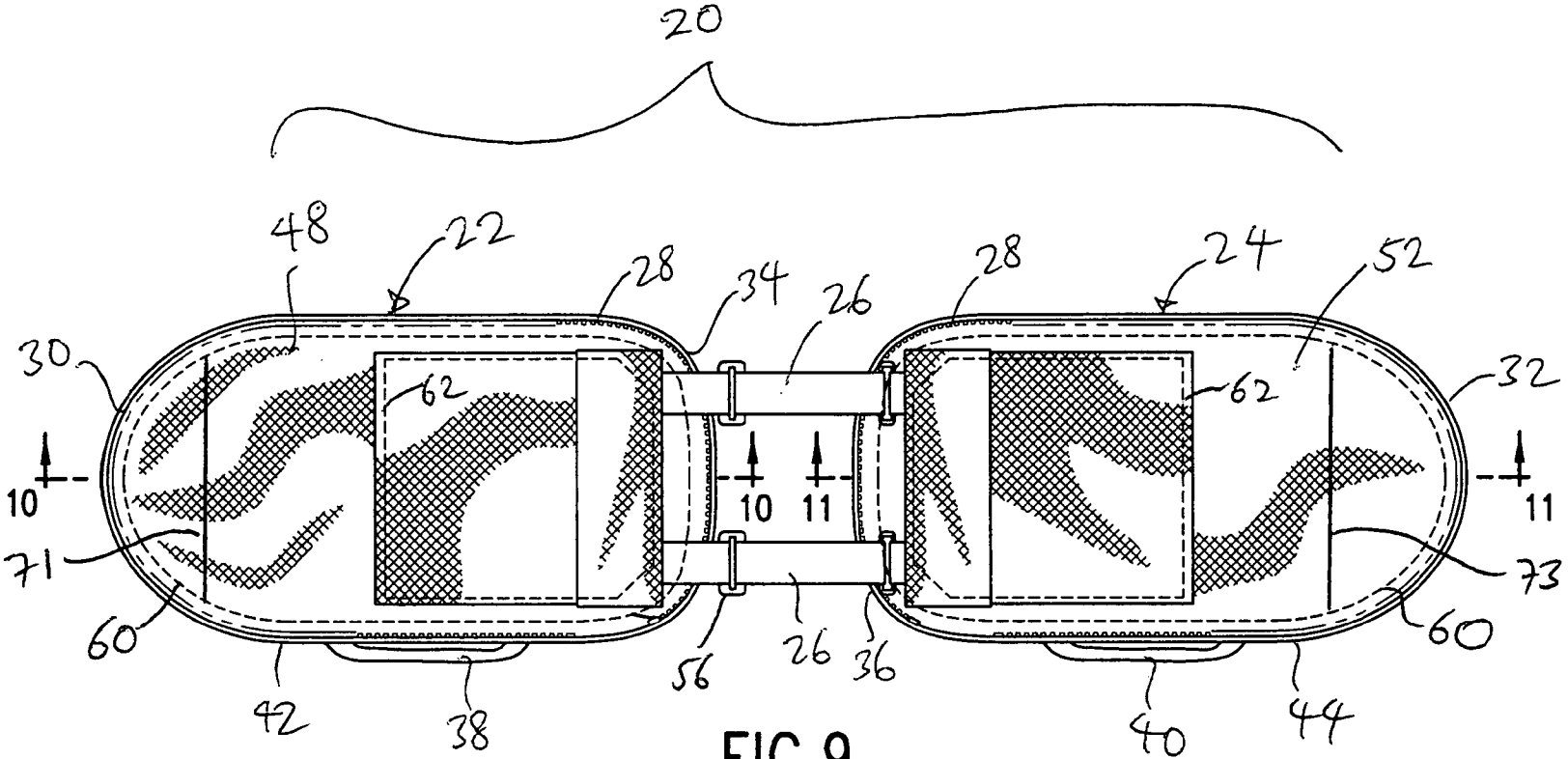
FIG. 9 is a top plan view of the body armor of FIG. 2 shown in an opened position.
Figure 10:
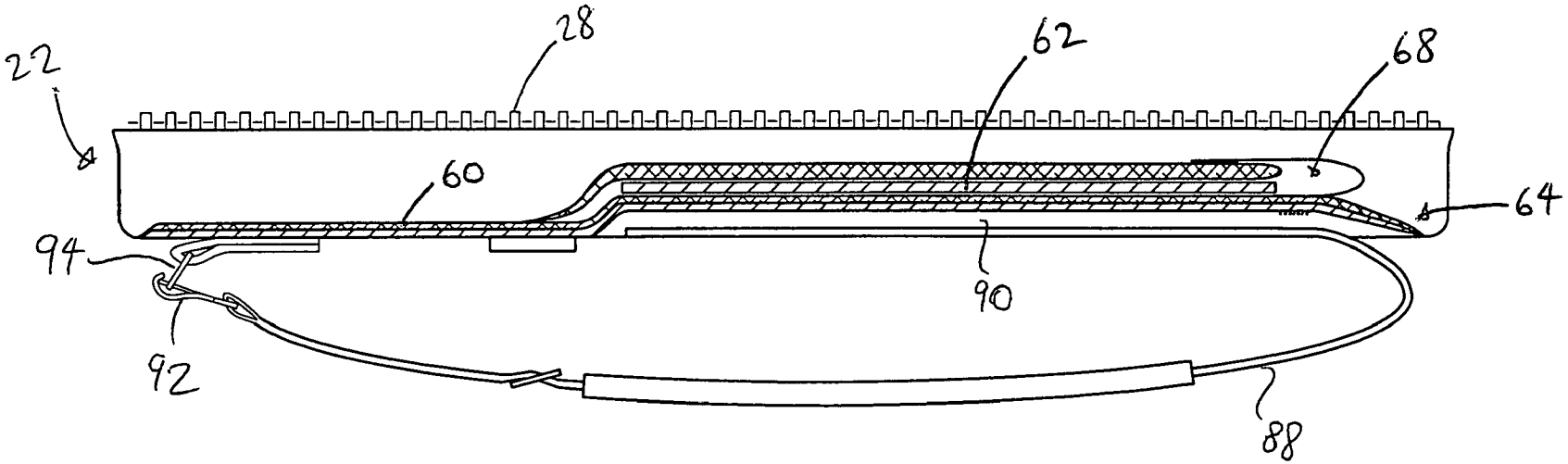
FIG. 10 is a cross-sectional view of the body armor taken along line 10-10 in FIG. 9.
Figure 11:
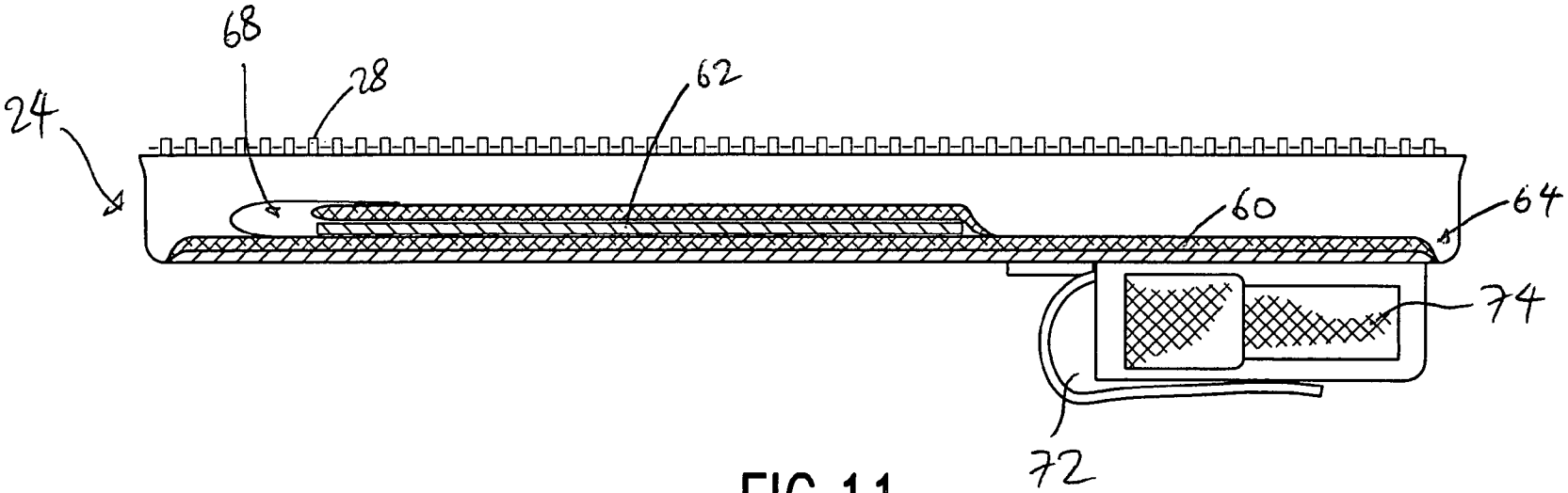
FIG. 11 is a cross-sectional view of the body armor taken along line 11-11 in FIG. 9.

As best shown in FIGS. 9-11, each panel 22 and 24 can include two types of body armor material. A soft body armor material 60 can be provided across most of the inner cavity of each panel 22 and 24; for example, extending to all the edges of the panels 22 and 24. A hard body armor material 62 can be provided at locations of the panels 22, 24 which are adapted to protect the more vulnerable parts of the user. For example, the hard body armor material 62 can be positioned closer to the inner/upper edges 34 and 36 of the panels 22 and 24, respectively, so that the hard body armor material 62 would be positioned over the chest and upper back regions of the user when the body armor 20 is worn by the user. As shown in FIGS. 9-11, the materials 60 and 62 can be overlapping at certain locations. The soft material 60 can be Kevlar-based materials that are rated by NIJ (National Institute of Justice) standards, including Categories I, II and IIIa. Typically soft ballistic armor protects against ballistic-caliber ammunition. The hard material 62 can be made out of ceramics, steel or similar hard material that are adapted to protect against rifle-caliber ammunition, including Categories III and IV as rated by the NIJ standards. The standard size of each piece of hard body armor material 62 can be 10" by 12". The position and use of the soft and hard materials 60 and 62 can be varied depending on the configuration and needs of the user. For example, either the soft material 60 or the hard material 62 can be omitted, or they can both be provided to cover the same or different locations. Each of the soft material 60 and the hard material 62 can be housed in different cavities 64 and 68, respectively, inside the inner cavity of the panels 22 and 24, respectively. The cavity 68 can be a pouch.

A foam insert can be positioned in the cavity 64 instead of the soft body armor material 60. For example, a 24" by 12" piece of foam can be interchangeable with the soft body armor material 60. Openings 71 and 73 can be provided on the inner surfaces 48 and 52, respectively, to provide access to the cavity 64 for interchanging the foam with the soft body armor material 60. Each opening 71 and 73 can be sealed by a VELCRO™ based connector.

As best seen in FIG. 9, the shoulder straps 26 have opposite ends that are secured to the inner surfaces 48 and 52 adjacent the inner/upper edges 34 and 36, respectively, of the panels 22 and 24, respectively. Each strap 26 can have an adjuster 56 that allows the length of the strap 26 to be adjusted. The two straps 26 are spaced apart by an appropriate distance that will allow the straps 26 to fit comfortably on the shoulders of an average adult. As shown in FIG. 9, the body armor 20 is ready to be placed over the shoulders of a user for use as a body vest. When used as a body vest, the body armor 20 assumes the orientation shown in FIGS. 4-6. In addition, an under-arm body strap 80 extends around the outer surfaces 46 and 50 of the panels 22 and 24, respectively, and is adapted to be fitted around the wearer'a waist (see FIG. 6) when the body armor 20 is worn as a body vest. The strap 80 includes buckles 82 for securing a portion of the strap 80 on one of the panels 22 or 24 to the other portion of the strap 80 on the other panel 24 or 22, essentially connecting the panels 22 and 24 together around a wearer's waist or body. The strap 80 also includes an adjuster 84 for adjusting the width of the strap 80 to fit snugly around the wearer's waist or body.

Figure 2:
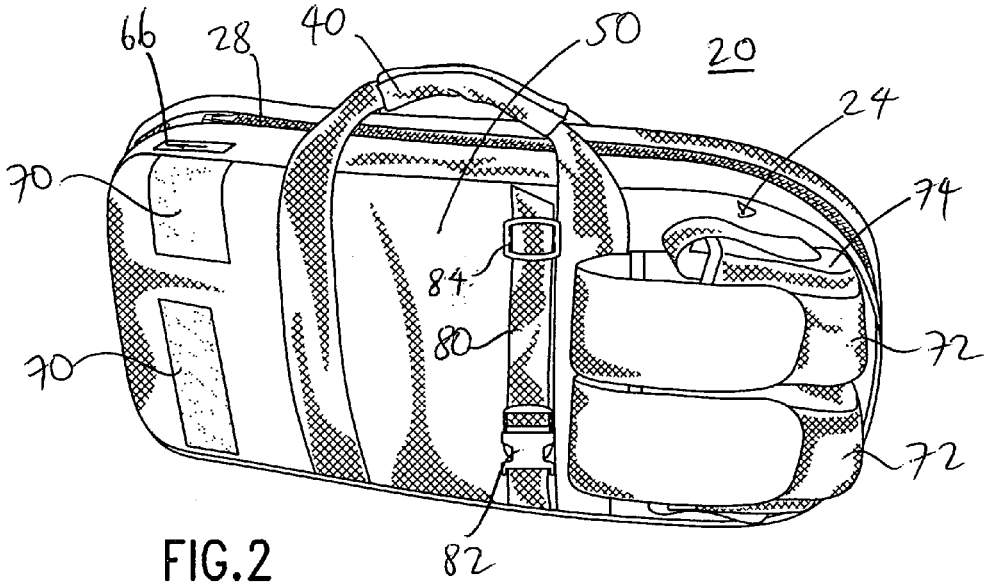
FIG. 2 is a perspective view of one side of the body armor of the present invention in use as a hand-held carrying bag.
Figure 3:
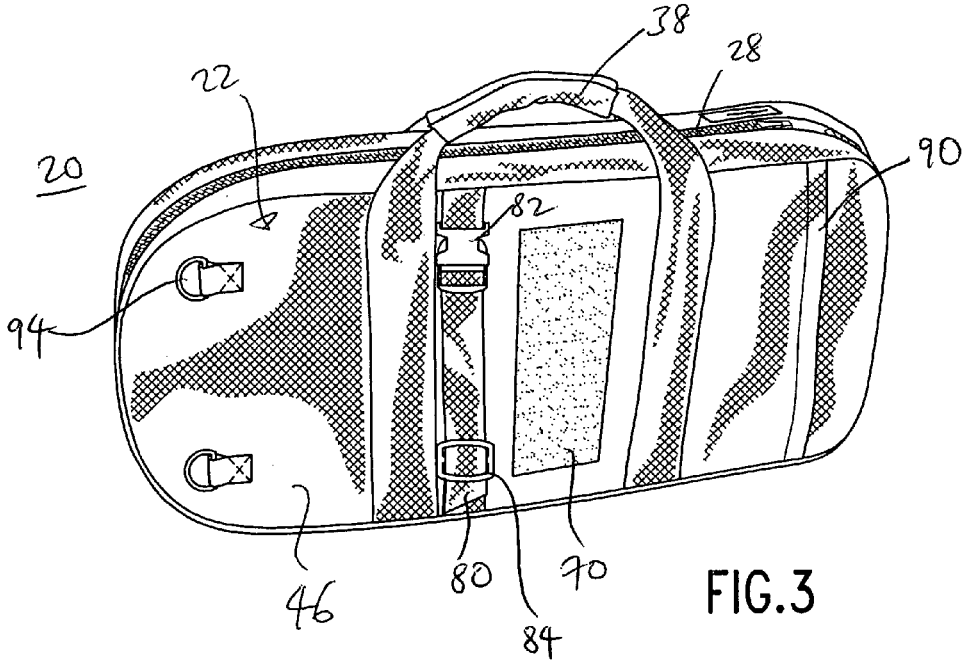
FIG. 3 is a perspective view of the other side of the body armor of FIG. 2.
Figure 4:
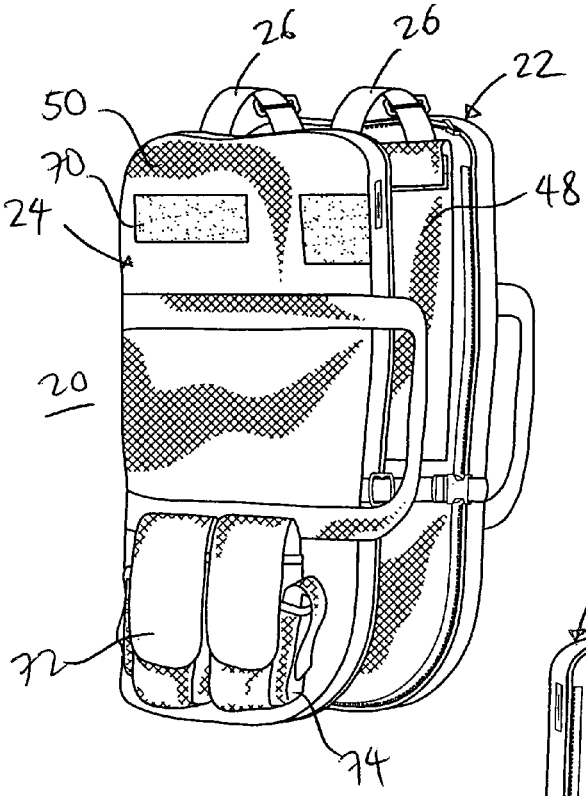
FIG. 4 is a perspective view of one side of the body armor of FIG. 2 deployed for use as a body vest that is adapted to be suspended over the shoulders of a wearer.
Figure 5:
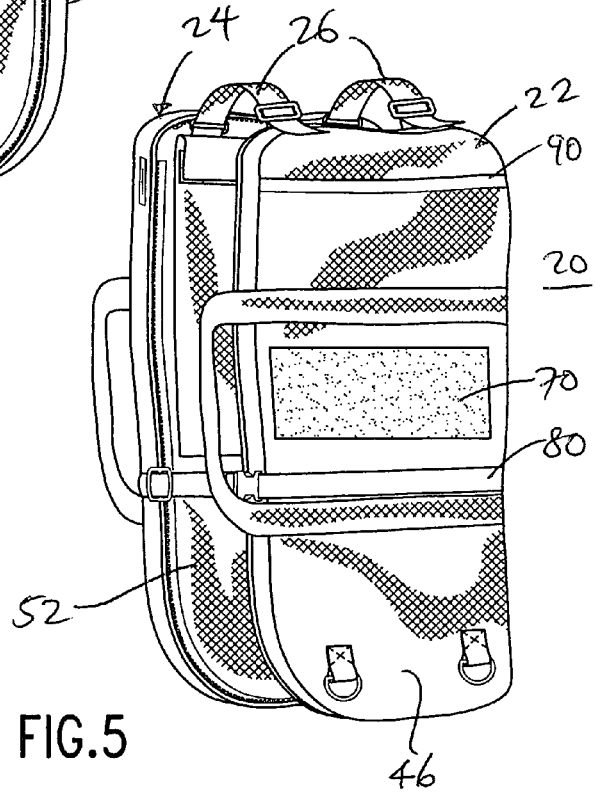
FIG. 5 is a perspective view of the other side of the body armor of FIG. 4.
Figure 6:
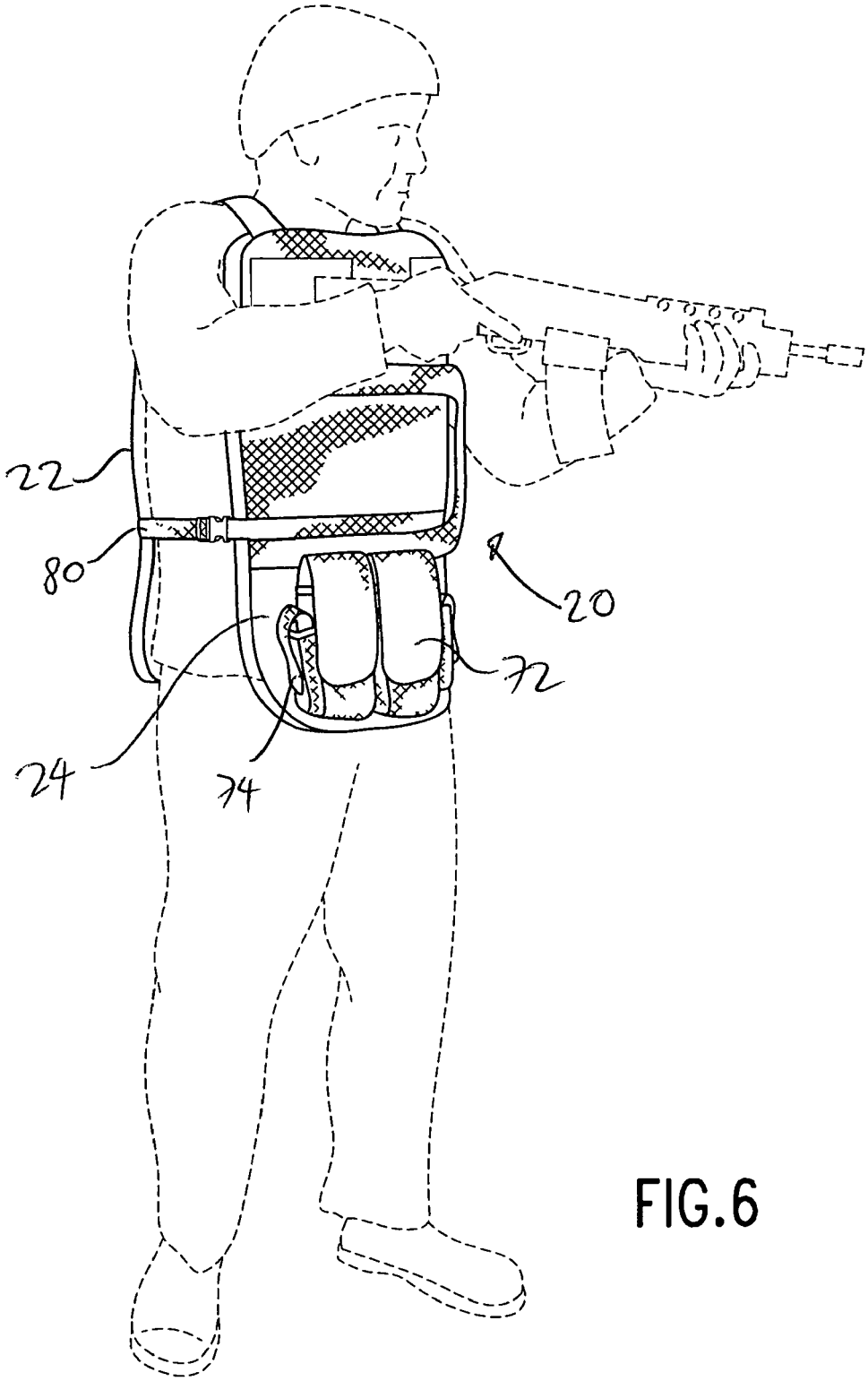
FIG. 6 illustrates the body armor of the present invention in use as a body vest.
Figure 7:
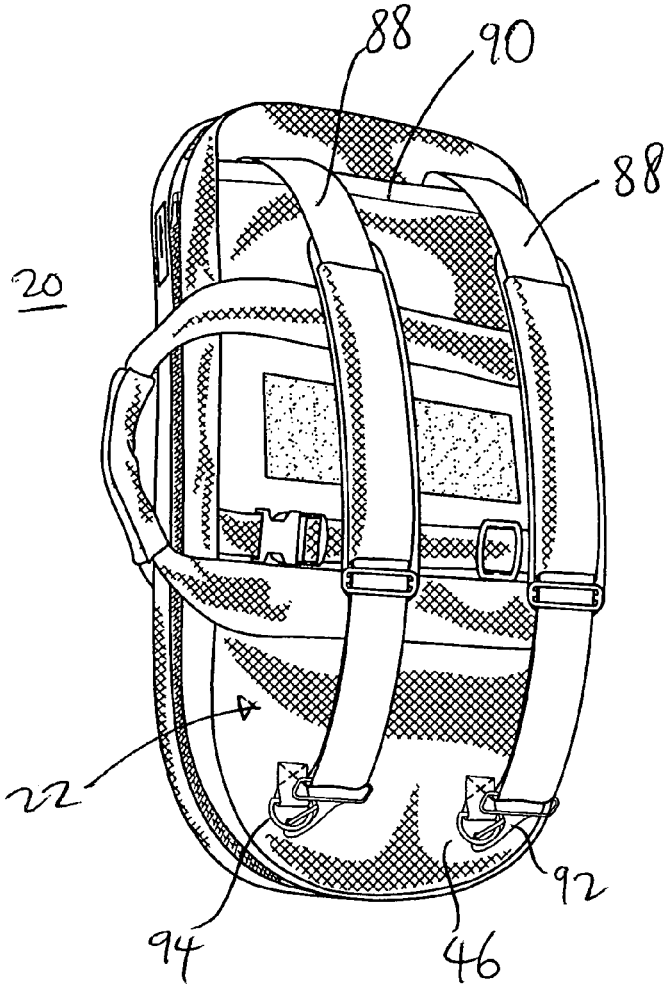
FIG. 7 is a perspective view of one side of the body armor of FIG. 2 deployed for use as a backpack.
Figure 8:
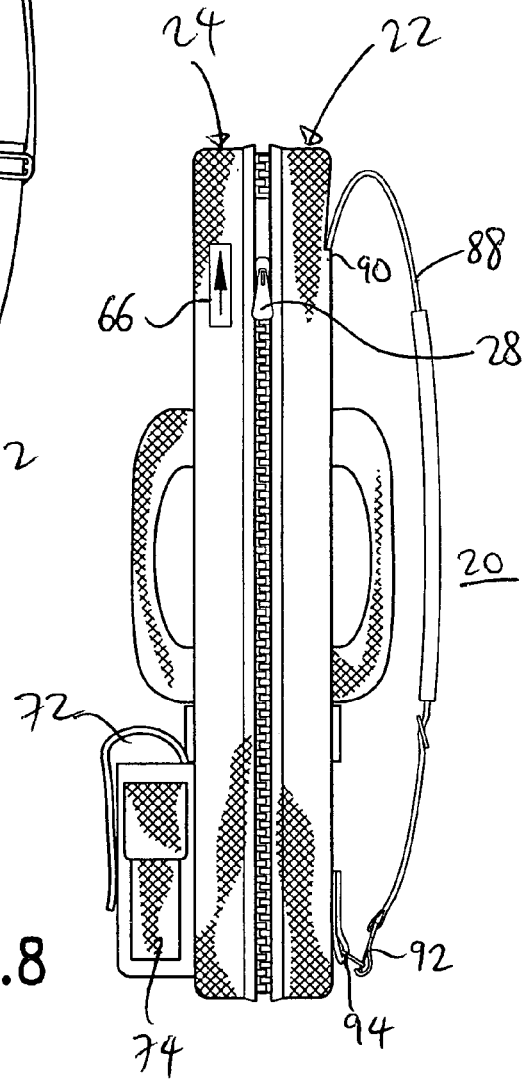
FIG. 8 is a side plan view of the body armor of FIG. 7.

However, the body armor 20 can be converted into a carrying bag by zipping up the zippers 28 so that the two panels 22, 24 form two opposing side walls that define an internal storage space, as best shown in FIGS. 1-3. The internal storage space is adapted to store and hold a weapon, which can include a sub-machine gun, a short-barreled assault rifle, shotgun, patrol rifle, assault rifle, sub-gun or shot-gun. When used as a carrying bag, the straps 26 can also be retained and concealed inside the internal storage space.

The convertible body armor 20 further includes a number of optional features. For example, a pictogram 66 (see FIGS. 2 and 8) can be provided on either panel 22 or 24, and can include an arrow to indicate the direction of the weapon muzzle. Connection patches 70 can be provided on any of the outer surfaces 46 and 50 of the panels 22 and 24, respectively, to facilitate the removable attachment of police or other security patches or markings when the body armor 20 is being used as a body vest. These connection patches 70 can be embodied in the form of removable connection mechanisms such as, but not limited to, VELCRO™ pads. A plurality of magazine pouches 72 can be provided on the outer surface 46 or 50 of either, or both, panel(s) 22 or 24 to store ammunition, such as standard thirty-round magazines, and clamp for most conventional short-barreled patrol rifles. A side pouch 74 can be provided on the side of a magazine pouch 74, or on any of the outer surfaces 46 or 50, to hold and store hand-cuffs.

The convertible body armor 20 of the present invention can also optionally include two backpack straps 88 that allow for the carrying bag to be carried in the form of a backpack. Referring to FIGS. 3, 5, 7 and 8, the backpack straps 88 can be normally retained and concealed inside a pocket 90 provided on the outer surface 46 of the panel 22. One end of each backpack strap 88 can be secured inside the pocket 90, and the other end of each backpack strap 88 can include a resilient hook 92 that is adapted to be removable connected to a corresponding eye connector 94 that is provided on the outer surface 46.

FIGS. 12-15 illustrate the optional incorporation of a protective hood 100 with the body armor 20 when the body armor 20 is used as a carrying bag for longer weapons 108, such as carbine weapons (e.g., M4, MP5A2, H&K) and weapons that are up to 38 inches in length. The hood 100 can be quickly and conveniently attached to one end of the carrying bag of the body armor 20, and quickly and conveniently removed when the body vest and the weapon 108 are to be deployed.

Figure 12:
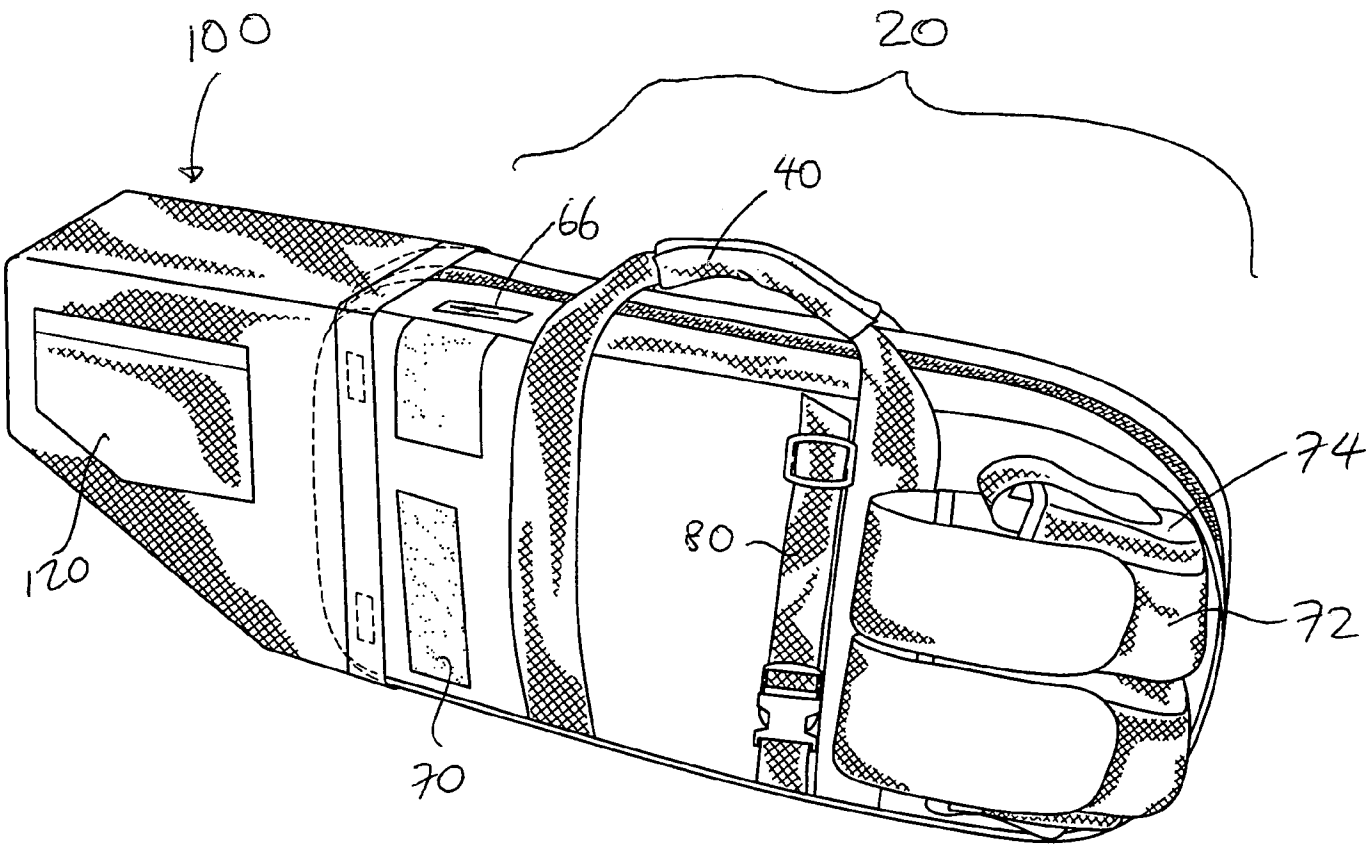
FIG. 12 illustrates the body armor of FIG. 2 shown with a protective hood attached thereto when in use as a hand-held carrying bag.
Figure 13:
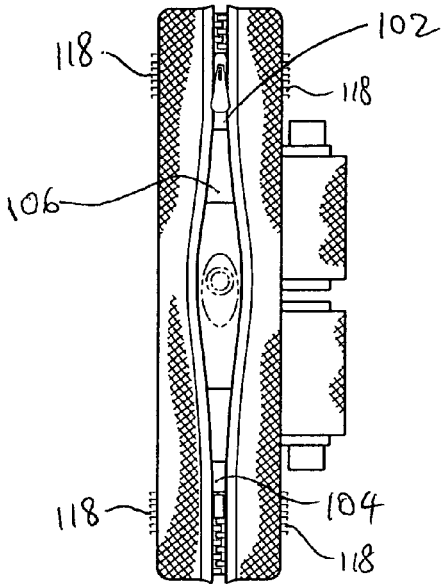
FIG. 13 is a side plan view of the body armor of FIG. 12 when in use as a hand-held carrying bag.
Figure 14:
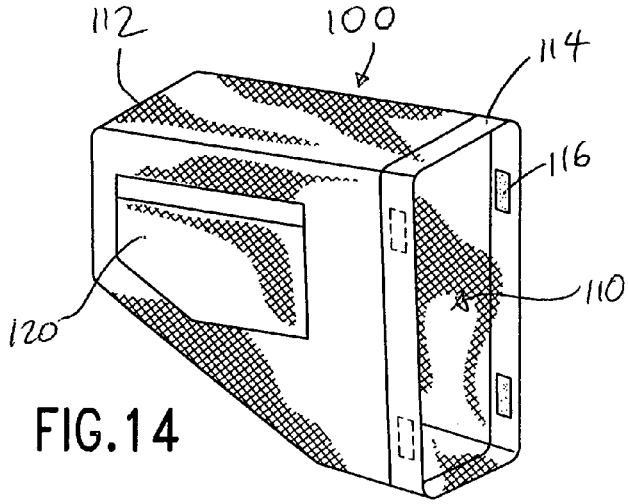
FIG. 14 is a perspective view of the protective hood of FIG. 12.
Figure 15:
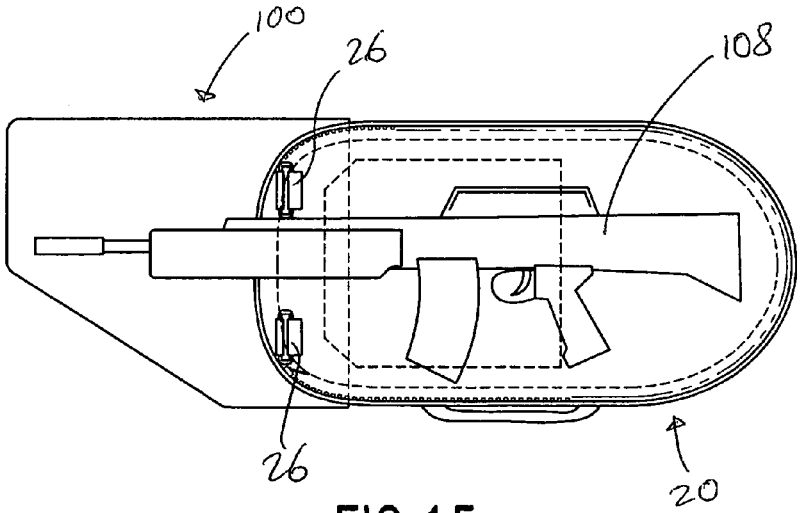
FIG. 15 is a cross-sectional view of the body armor of FIG. 12 when in use as a hand-held carrying bag showing the retention of a weapon therein.

As best shown in FIGS. 12-15, the zipper 28 for the panels 22, 24 has a start point 102 and an end point 104 that are provided along the inner/upper edges 34 and 36 of the panels 22 and 24, respectively. A space 106 is defined between the start point 102 and the end point 104 to facilitate the barrel of the weapon 108 extending there through. The points 102, 104 and the space 106 are provided at the shoulder strap end (i.e., the ends of the panels 22, 24 where the shoulder straps 26 are located) of the body armor 20, and as best shown in FIG. 12, the pictogram 66 points in the correct direction of the barrel of the weapon 108.

The hood 100 has an opened end 110 that is adapted to receive the barrel of the weapon 108, and a closed front end 112 that is opposite the opened end 110. A border flap 114 extends around the opened end 110, and a plurality of removable connection mechanisms (e.g., VELCRO™ pads) 116 can be provided in spaced-apart manner along the inner surface of the border flap 114 to removable attach the opened end 110 of the hood 100 to the shoulder strap end of the carrying bag of the body armor 20. Corresponding removable connection mechanisms (e.g., VELCRO™ pads) 118 can be provided on the outer surfaces 46 and 50 of the panels 22 and 24, respectively, to engage the connection mechanisms 116. An optional pouch 120 can be provided on an outer surface of the hood 100 for holding cleaning supplies or any other desired items.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A convertible apparatus, comprising:

a first panel having body armor material incorporated therein, the first panel having a periphery that includes a first edge and a first set of fasteners connected to the first panel that extend about a majority of the periphery of the first panel;

a second panel having body armor material incorporated therein, the second panel having a periphery that includes a first edge and a second set of fasteners connected to the second panel that extend about a majority of the periphery of the second panel, the second set of fasteners corresponding to the first set of fasteners for removable mating engagement;

a pair of shoulder straps, each having a first end secured to the first panel adjacent the first edge of the first panel, and a second end secured to the second panel adjacent the first edge of the second panel, with the shoulder straps spaced apart from each other; and (i) the first and second set of fasteners connecting a majority of the peripheries of the first and second panels together when in mating engagement so that the first and second panels form an internal storage cavity; and (ii) the first and second panels form a body vest with the first panel covering a front portion of a user and the second panel covering a rear portion of the user with the shoulder straps supported on the user's shoulders when the first and second set of fastener are disengaged.

2. The apparatus of claim 1, further including a body strap provided on the panels, and extending around the torso of the user when the panels are worn as the body vest.

3. The apparatus of claim 1, further including a backpack strap that has opposite ends that are attached to opposite ends of the first panel.

4. The apparatus of claim 1, further including:

wherein the peripheries of the first and second panels also comprises a second edge and a third edge, the second edge opposite the first edge, and the third and fourth edge connecting ends of the second and first edges; and a handle provided on at least one of the first and second panels and extending from the third edge.

5. The apparatus of claim 1 wherein the internal storage cavity is a substantially enclosed volume.

6. The apparatus of claim 1, wherein the first set of fasteners is a first strip of zipper teeth and the second set of fasteners is a second ship of zipper teeth.

7. The apparatus of claim 6 wherein the first set of zipper teeth extend along the entire periphery of the first panel and the second set of zipper teeth extend along the entire periphery of the second panel.

8. The apparatus of claim 1, further including a pictogram on at least one of the panels for indicating the direction of a barrel of a weapon that is to be stored in the interior storage space.

9. The apparatus of claim 1, further including a hood that is removably connected to the first edges of the panels.

10. The apparatus of claim 1, wherein the body armor material in the first panel includes a soft body armor material and a separate hard body armor material.

11. An assembly, comprising:

a first four-sided panel having body armor material incorporated therein, the first panel having a periphery that includes a first edge and a first set of fasteners that extend about the periphery of the first panel for at least three sides;

a second four sided panel having body armor material incorporated therein, the second panel having a periphery that includes a first edge and a second set of fasteners that extend about the periphery of the second panel for at least three sides, the second set of fasteners corresponding to the first set of fasteners for removable mating engagement;

a pair of shoulder straps, each having a first end secured to the first panel adjacent the first edge of the first panel, and a second end secured to the second panel adjacent the first edge of the second panel, with the shoulder straps spaced apart from each other;

(i) the first and second set of fasteners connecting the peripheries of the first and second panels together along the at least three sides when in mating engagement so that the first and second panels form an internal storage space; and (ii) the first and second panels form a body vest with the first panel covering a front portion of a user and the second panel coveting a rear portion of the user with the shoulder straps supported on the user's shoulders when the first and second set of fastener are disengaged; and a weapon retained in the internal storage space.

12. The assembly of claim 11, further including a body strap provided on the panels, and extending around the torso of the user when the first and second panels are worn as a body vest.

13. The assembly of claim 11, further including a backpack strap that has opposite ends that are attached to opposite ends of the first panel.

14. The assembly of claim 11, further including a handle provided on at least one of the panels.

15. The assembly of claim 11, wherein the body armor material in the first panel includes a soft body armor material and a separate hard body armor material.

16. The assembly of claim 11, further including a connection patch provided on at least one of the panels.

17. The assembly of claim 11, further including a pictogram on at least one of the panels for indicating the direction of a barrel of the weapon.

18. The assembly of claim 11, further including a hood that is removably connected to the first edges of the panels, the hood having an interior and an opened end, wherein a barrel of the weapon extends through the space between the shoulder straps and through the opened end of the hood into the interior of the hood.

19. The assembly of claim 18, wherein the hood has a removable connector provided at the opened end to removably connect the opened end to the panels adjacent the first edges of the panels.

20. A convertible apparatus comprising:

a first panel having body armor material incorporated therein, the first panel having a periphery that includes a first edge and a first strip of zipper teeth connected to the first panel that extend about a majority of the periphery of the first panel;

a second panel having body armor material incorporated therein, the second panel having a periphery that includes a first edge and a second strip of zipper teeth connected to the second panel that extend about a majority of the periphery of the second panel, the second strip of zipper teeth corresponding to the first strip of zipper teeth for mating engagement;

a pair of shoulder straps, each having a first end secured to the first panel adjacent the first edge of the first panel, and a second end secured to the second panel adjacent the first edge of the second panel, with the shoulder straps spaced apart from each; and i) the first and second strip of zipper teeth connecting a majority of the peripheries of the first and second panels together when in mating engagement so that the first and second panels form an internal storage space therebetween; and (ii) the first and second panels forming a body vest with the first panel covering a front portion of a user and the second panel covering a rear portion of the user with the shoulder straps supported on the user's shoulders when the first and second strips of zipper teeth are not in mating engagement.

* * * * *